US011558697B2

(12) United States Patent
Usher

(10) Patent No.: US 11,558,697 B2
(45) Date of Patent: Jan. 17, 2023

(54) METHOD TO ACQUIRE PREFERRED DYNAMIC RANGE FUNCTION FOR SPEECH ENHANCEMENT

(71) Applicant: Staton Techiya LLC, Lighthouse Point, FL (US)

(72) Inventor: John Usher, Beer (GB)

(73) Assignee: Staton Techiya, LLC, Delray Beach, FL (US)

( * ) Notice: Subject to any disclaimer, the term of this patent is extended or adjusted under 35 U.S.C. 154(b) by 0 days.

(21) Appl. No.: 17/139,844

(22) Filed: Dec. 31, 2020

(65) Prior Publication Data

US 2021/0127216 A1 Apr. 29, 2021

Related U.S. Application Data

(63) Continuation of application No. 16/375,818, filed on Apr. 4, 2019, now Pat. No. 10,951,994.

(60) Provisional application No. 62/652,381, filed on Apr. 4, 2018.

(51) Int. Cl.
*H04R 25/00* (2006.01)

(52) U.S. Cl.
CPC ..... *H04R 25/505* (2013.01); *H04R 2225/43* (2013.01)

(58) Field of Classification Search
CPC .. H04R 25/505; H04R 2225/43; H04R 25/70; H04R 2460/15
See application file for complete search history.

(56) References Cited

U.S. PATENT DOCUMENTS

| | | | |
|---|---|---|---|
| 3,876,843 | A | 4/1975 | Moen |
| 4,054,749 | A | 10/1977 | Suzuki et al. |
| 4,088,849 | A | 5/1978 | Usami et al. |
| 4,947,440 | A | 8/1990 | Bateman et al. |
| 5,208,867 | A | 5/1993 | Stites, III |
| 5,267,321 | A | 11/1993 | Langberg |
| 5,524,056 | A | 6/1996 | Killion et al. |
| 5,903,868 | A | 5/1999 | Yuen et al. |
| 6,021,207 | A | 2/2000 | Puthuff et al. |
| 6,021,325 | A | 2/2000 | Hall |
| 6,094,489 | A | 7/2000 | Ishige et al. |
| 6,163,338 | A | 12/2000 | Johnson et al. |
| 6,163,508 | A | 12/2000 | Kim et al. |

(Continued)

FOREIGN PATENT DOCUMENTS

| | | |
|---|---|---|
| EP | 1519625 A2 | 3/2005 |
| EP | 2375782 | 10/2011 |
| WO | 2006037156 A1 | 4/2006 |

OTHER PUBLICATIONS

Olwal, A. and Feiner S. Interaction Techniques Using Prosodic Features of Speech and Audio Localization. Proceedings of IUI 2005 (International Conference on Intelligent User Interfaces), San Diego, CA, Jan. 9-12, 2005, p. 284-286.

(Continued)

*Primary Examiner* — Oyesola C Ojo
(74) *Attorney, Agent, or Firm* — Akerman LLP; Peter A. Chiabotti

(57) ABSTRACT

At least one exemplary embodiment is directed to a method of generating preferred dynamic range function to process audio reproduced by an earphone device. The function includes processing the audio to improve speech intelligibility. The function is acquired with a self-administered hearing test.

22 Claims, 9 Drawing Sheets

(56) References Cited

U.S. PATENT DOCUMENTS 6,226,389 B1 5/2001 Lemelson et al.
6,298,323 B1 10/2001 Kaemmerer
6,359,993 B2 3/2002 Brimhall
6,400,652 B1 6/2002 Goldberg et al.
6,415,034 B1 7/2002 Hietanen
6,567,524 B1 5/2003 Svean et al.
RE38,351 E 12/2003 Iseberg et al.
6,661,901 B1 12/2003 Svean et al.
6,728,385 B2 4/2004 Kvaloy et al.
6,748,238 B1 6/2004 Lau
6,754,359 B1 6/2004 Svean et al.
6,804,638 B2 10/2004 Fiedler
6,804,643 B1 10/2004 Kiss
6,970,570 B2 * 11/2005 Goldstein ..... H04R 25/356 381/106
7,050,966 B2 * 5/2006 Schneider ..... G10L 21/0208 704/E21.009
7,072,482 B2 7/2006 Van Doorn et al.
7,107,109 B1 9/2006 Nathan et al.
7,209,569 B2 4/2007 Boesen
7,430,299 B2 9/2008 Armstrong et al.
7,433,714 B2 10/2008 Howard et al.
7,450,730 B2 11/2008 Bertg et al.
7,477,756 B2 1/2009 Wickstrom et al.
7,562,020 B2 6/2009 Le et al.
7,756,285 B2 7/2010 Sjursen et al.
7,778,434 B2 8/2010 Juneau et al.
7,920,557 B2 4/2011 Moote
8,014,553 B2 9/2011 Radivojevic et al.
8,019,105 B2 9/2011 Kates
8,493,204 B2 7/2013 Wong et al.
8,750,295 B2 6/2014 Liron
8,913,754 B2 * 12/2014 McClain ..... H03G 9/025 381/106
9,037,458 B2 5/2015 Park et al.
9,123,343 B2 9/2015 Kurki-Suonio
9,135,797 B2 9/2015 Couper et al.
9,672,834 B2 6/2017 Pandey et al.
2001/0046304 A1 11/2001 Rast
2002/0076057 A1 * 6/2002 Voix ..... A61F 11/08 381/328
2002/0106091 A1 8/2002 Furst et al.
2002/0118798 A1 8/2002 Langhart et al.
2003/0144603 A1 7/2003 Zoth
2003/0161097 A1 8/2003 Le et al.
2003/0165246 A1 9/2003 Kvaloy et al.
2004/0042103 A1 3/2004 Mayer
2004/0109668 A1 6/2004 Stuckman
2004/0125965 A1 7/2004 Alberth, Jr. et al.
2004/0190737 A1 9/2004 Kuhnel et al.
2004/0196992 A1 10/2004 Ryan
2004/0203351 A1 10/2004 Shearer et al.
2005/0078838 A1 4/2005 Simon
2005/0123146 A1 6/2005 Voix et al.
2005/0288057 A1 12/2005 Lai et al.
2006/0067551 A1 3/2006 Cartwright et al.
2006/0083395 A1 4/2006 Allen et al.
2006/0092043 A1 5/2006 Lagassey
2006/0195322 A1 8/2006 Broussard et al.
2006/0204014 A1 9/2006 Isenberg et al.
2007/0043563 A1 2/2007 Comerford et al.
2007/0086600 A1 4/2007 Boesen
2007/0189544 A1 8/2007 Rosenberg
2007/0291953 A1 12/2007 Ngia et al.
2008/0037801 A1 2/2008 Alves et al.
2008/0165988 A1 7/2008 Terlizzi et al.
2009/0010456 A1 1/2009 Goldstein et al.
2009/0024234 A1 1/2009 Archibald
2010/0061564 A1 3/2010 Clemow et al.
2010/0296668 A1 11/2010 Lee et al.
2011/0096939 A1 4/2011 Ichimura
2011/0264447 A1 10/2011 Visser et al.
2011/0293103 A1 12/2011 Park et al.
2013/0054251 A1 * 2/2013 Eppolito ..... H03G 7/002 704/500
2013/0266166 A1 * 10/2013 Dressler ..... H04R 25/356 381/321
2014/0093094 A1 * 4/2014 Goldstein ..... H04R 3/00 381/74
2016/0104452 A1 4/2016 Guan et al.
2016/0142538 A1 * 5/2016 Bredikhin ..... G10L 21/0364 379/52
2017/0265786 A1 * 9/2017 Fereczkowski ..... A61B 5/123
2018/0152795 A1 * 5/2018 Lee ..... H04R 1/1041
2018/0218742 A1 * 8/2018 Baumgarte ..... H04S 3/008
2019/0065140 A1 * 2/2019 Koppens ..... H03G 7/007

OTHER PUBLICATIONS

Bernard Widrow, John R. Glover Jr., John M. McCool, John Kaunitz, Charles S. Williams, Robert H. Hearn, James R. Zeidler, Eugene Dong Jr, and Robert C. Goodlin, Adaptive Noise Cancelling: Principles and Applications, Proceedings of the IEEE, vol. 63, No. 12, Dec. 1975.

Mauro Dentino, John M. McCool, and Bernard Widrow, Adaptive Filtering in the Frequency Domain, Proceedings of the IEEE, vol. 66, No. 12, Dec. 1978.

*Samsung Electronics Co., Ltd., and Samsung Electronics, America, Inc.*, v. *Staton Techiya, LLC*, IPR2022-00282, Dec. 21, 2021.

*Samsung Electronics Co., Ltd., and Samsung Electronics, America, Inc.*, v. *Staton Techiya, LLC*, IPR2022-00242, Dec. 23, 2021.

*Samsung Electronics Co., Ltd., and Samsung Electronics, America, Inc.*, v. *Staton Techiya, LLC*, IPR2022-00243, Dec. 23, 2021.

*Samsung Electronics Co., Ltd., and Samsung Electronics, America, Inc.*, v. *Staton Techiya, LLC*, IPR2022-00234, Dec. 21, 2021.

*Samsung Electronics Co., Ltd., and Samsung Electronics, America, Inc.*, v. *Staton Techiya, LLC*, IPR2022-00253, Jan. 18, 2022.

*Samsung Electronics Co., Ltd., and Samsung Electronics, America, Inc.*, v. *Staton Techiya, LLC*, IPR2022-00324, Jan. 13, 2022.

*Samsung Electronics Co., Ltd., and Samsung Electronics, America, Inc.*, v. *Staton Techiya, LLC*, IPR2022-00281, Jan. 18, 2022.

*Samsung Electronics Co., Ltd., and Samsung Electronics, America, Inc.*, v. *Staton Techiya, LLC*, IPR2022-00302, Jan. 13, 2022.

*Samsung Electronics Co., Ltd., and Samsung Electronics, America, Inc.*, v. *Staton Techiya, LLC*, IPR2022-00369, Feb. 18, 2022.

*Samsung Electronics Co., Ltd., and Samsung Electronics, America, Inc.*, v. *Staton Techiya, LLC*, IPR2022-00388, Feb. 18, 2022.

*Samsung Electronics Co., Ltd., and Samsung Electronics, America, Inc.*, v. *Staton Techiya, LLC*, IPR2022-00410, Feb. 18, 2022.

* cited by examiner

METHOD TO ACQUIRE PREFERRED DYNAMIC RANGE FUNCTION FOR SPEECH ENHANCEMENT

CROSS-REFERENCE TO RELATED APPLICATIONS

This application is a continuation of and claims priority to application Ser. No. 16/375,818, filed 4 Apr. 2019, which is a non provisional of and claims priority to U.S. Pat. App. No. 62/652,381, filed 4 Apr. 2018, the disclosure of all of which are incorporated herein by reference in their entirety.

FIELD OF THE INVENTION

The present invention relates in general to methods for modification of audio content and in particular, though not exclusively, for the personalization of audio content to improve speech intelligibility using a multi band compressor.

BACKGROUND OF THE INVENTION

Dynamic range compression is an audio processing technique that reduces the volume of loud sounds (compression) or amplifies quiet sounds (expansion). Such a compression and expansion process is undertaken by an algorithm called a compander, though is generally called a (dynamic range) compressor.

When compression is undertaken on a speech signal, the perceived speech intelligibility of the processed signal can be enhanced. Speech intelligibility can be measured in a number of ways, one such objective metric being taken as a percentage of correctly understood words. Alternatively, a subjective metric can be measured as a preference for one auditioned signal over another.

A compression curve can be used to describe the input-to-output mapping of a signal before and after the compressor system, for instance the time-averaged input signal level on the x axis and the time-averaged output signal level on the y axis. Such a compressor system can operate on a speech audio signal and the shape of the curve is known to affect speech intelligibility. Typically, the speech audio signal is from a microphone, or a signal from a playback of a recording of a speech audio signal from a storage medium, and typically the processed output signal is directed to a loudspeaker and auditioned by a human listener.

The optimum or preferred compressor curve shape for enhanced speech intelligibility is different depending on the level (i.e. sound pressure level, SPL) of the acoustic stimulus, the frequency range over which the compression function operates on the input signal. The optimum curve shape also differs for different individuals due to individual hearing sensitivity changes from damage within the auditory system, e.g. hair-cell damage in the inner ear. The optimum curve shape also depends on the acoustic environment in which the user is located, for instance depending on how echoic the environment is (a highly echoic environment is one such as a large hall or indoor sports arena where the reverberation time is large, as contrasted with an environment where the reverberation time is low, such as a small furnished room or an outdoor environment such as an open field or wood).

The dynamic range compression function (DRCF) is here defined as a collection of optimal compression curves determined for a specific individual to enhance speech intelligibility. The curves are determined for different frequency regions and different acoustic environments.

An DRCF can be used with a hearing enhancement system worn by a user to increase the speech intelligibility of the user in the presence of human speech, where the source of the human speech may be from an actual human in the local environment or from a reproduction of a human voice from a loudspeaker, such as a TV or public address system. A hearing enhancement system can be generally classified as a hearing aid, for instance a hearing aid prescribed for hearing impairment and also for Personal Sound Amplification Products (PSAPs) that do general not require a medical prescription.

Current hearing enhancement fitting systems and methods to acquire a compression function are generally complex, relying on specialized instruments for operation by hearing professionals in clinical settings, or using dedicated hardware if the test is self-administered. For example, a compression acquisition system to acquire a compression curve or frequency dependent compression curve for speech intelligibility enhancement can comprise an audiometer for conducting a hearing evaluation, a software program for computing prescriptive formulae and corresponding fitting parameters, a hearing aid programming instrument to program the computed fitting parameters, a real ear measurement for in-situ evaluation of the hearing aid, a hearing aid analyzer, sound isolation chamber, and calibrated microphones.

Hearing aid consumers are generally asked to return to the dispensing office to make adjustments following real-life listening experiences with the hearing device. When simulated "real life" sounds are employed for hearing aid evaluation, calibration of the real life input sounds at the microphone of the hearing aid is generally required, involving probe tube measurements, or a sound level meter (SLM). Regardless of the particular method used, conventional fitting generally requires clinical settings to employ specialized instruments for administration by trained hearing professionals. Throughout this application, the term "consumer" generally refers to a person being fitted with a hearing device, thus may be interchangeable with any of the terms "user," "person," "client," "hearing impaired," etc. Furthermore, the term "hearing device" is used herein to refer to all types of hearing enhancement devices, including hearing aids prescribed for hearing impairment and personal sound amplification products (PSAP) generally not requiring a prescription or a medical waiver.

BRIEF DESCRIPTION OF THE DRAWINGS

Exemplary embodiments of present invention will become more fully understood from the detailed description and the accompanying drawings, wherein.

DETAILED DESCRIPTION OF EXEMPLARY EMBODIMENTS

Figure 1:
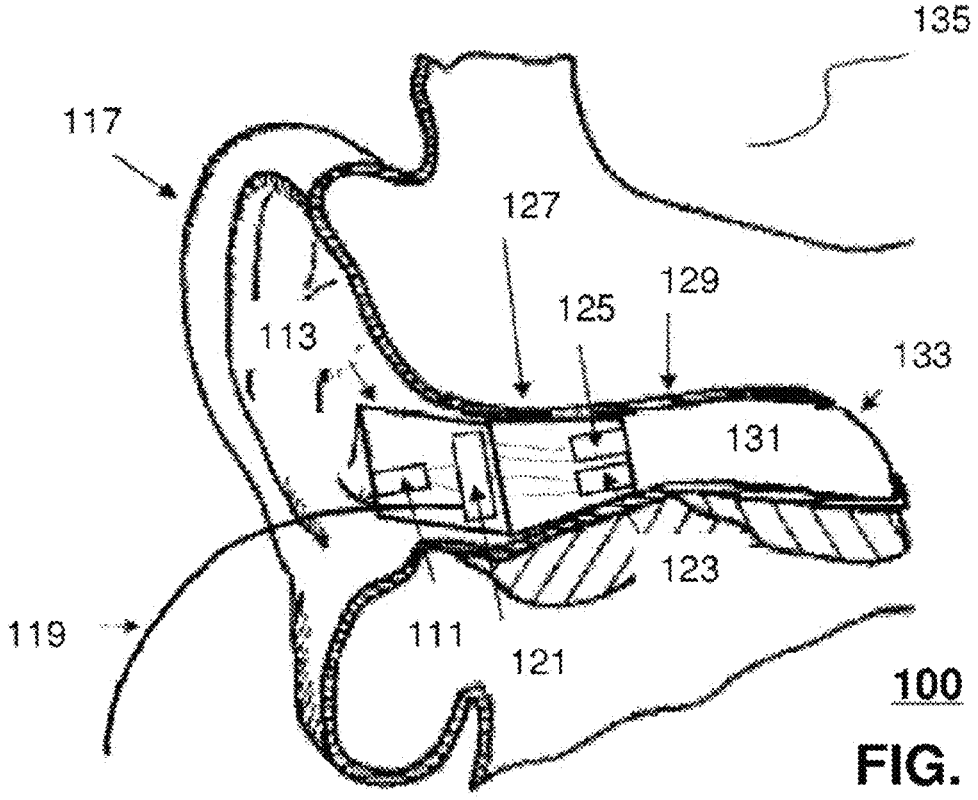
FIG. 1 shows a diagram of an earpiece in accordance with an exemplary embodiment.

The following description of exemplary embodiment(s) is merely illustrative in nature and is in no way intended to limit the invention, its application, or uses.

In at least one exemplary embodiment, the input audio signals are from a microphone mounted in an earphone device, that detects sounds in the ambient sound around the earphone wearer (the user of the earphone), and the output signal is directed to an earphone in the earphone device and heard by the earphone user.

At least one exemplary embodiment introduces a method using an earphone device with an ear canal microphone to measure the sound pressure level of the presented stimuli. The earphone contains a sound isolating component, so the ambient sound field is not required to be as low as with conventional DRCF tests. Thus, the current invention provides advantages over extant compression curve acquisition methods in that the DRCF tests can be undertaken in more typical every day sound environments using earphone devices that the user can then use for music reproduction, voice communication, and ambient sound listening with an enhanced and improved intelligibility.

Exemplary embodiments are directed to or can be operatively used on various wired or wireless audio devices (e.g., hearing aids, ear monitors, earbuds, headphones, ear terminal, behind the ear devices or other acoustic devices as known by one of ordinary skill, and equivalents). For example, the earpieces can be without transducers (for a noise attenuation application in a hearing protective earplug) or one or more transducers (e.g. ambient sound microphone (ASM), ear canal microphone (ECM), ear canal receiver (ECR)) for monitoring/providing sound. In all of the examples illustrated and discussed herein, any specific values should be interpreted to be illustrative only and non-limiting. Thus, other examples of the exemplary embodiments could have different values.

Processes, techniques, apparatus, and materials as known by one of ordinary skill in the art may not be discussed in detail but are intended to be part of the enabling description where appropriate. For example, specific materials may not be listed for achieving each of the targeted properties discussed, however one of ordinary skill would be able, without undo experimentation, to determine the materials needed given the enabling disclosure herein.

Notice that similar reference numerals and letters refer to similar items in the following figures, and thus once an item is defined in one figure, it may not be discussed or further defined in the following figures. Processes, techniques, apparatus, and materials as known by one of ordinary skill in the relevant art may not be discussed in detail but are intended to be part of the enabling description where appropriate.

A Dynamic Range Compression Function can be used to process an audio content signal, providing the user/system with an enhanced and improved listening experience optimized for their anthropometrical measurements, anatomy relevant to audition, playback hardware, and personal preferences.

The dynamic range compression function (DRCF) is defined as a single or a collection of compression curves determined for a specific individual to enhance speech intelligibility and general sound quality. The curves are determined for either a single or for multiple frequency bands and optionally for different acoustic environments.

Current hearing enhancement fitting systems and methods to acquire a DRCF are generally complex, relying on specialized instruments for operation by hearing professionals in clinical settings, or using dedicated hardware if the test is self-administered. For example, a DRCF measurement system can comprise an audiometer for conducting a hearing evaluation, a software program for computing prescriptive formulae and corresponding fitting parameters, a hearing aid programming instrument to program the computed fitting parameters, a real ear measurement for in-situ evaluation of the hearing aid, a hearing aid analyzer, sound isolation chamber, calibrated microphones.

Characterization and verification of a DRCF is generally conducted by presenting acoustic stimuli (i.e. reproducing an audio signal) with a loudspeaker of a hearing device, such as a loudspeaker or earphone. The hearing aid is often worn in the ear (in-situ) during the fitting process. The hearing aid may also need to be placed in a test chamber for characterization by a hearing aid analyzer.

The acoustic stimulus used for DRCF acquisition generally uses pure audio tones. One non-limiting example of the present invention presents band-passed music audio (presented stimuli), with the music selection being chosen by the user. This provides an advantage over extant tone based methods in that the DRCF test will be subjectively more enjoyable for the user and more appealing, with the added benefit of supporting marketing slogans such as "test your ears using your own music."

One exemplary embodiment of the current invention introduces a method using an earphone device with at least one ear canal microphone configured to measure the sound pressure level of the presented stimuli. The earphone includes a sound isolating component, so the ambient sound field is not required to be as low as with conventional DRCF tests. Thus, the current invention provides advantages over extant DRCF acquisition methods in that the DRCF tests can be undertaken in more typical every day sound environments using earphone devices that the user can then use for music reproduction, voice communication, and ambient sound listening with an enhanced and improved intelligibility.

Hearing aid consumers are generally asked to return to the dispensing office to make adjustments following real-life listening experiences with the hearing device. When simulated "real life" sounds are employed for hearing aid evaluation, calibration of the real life input sounds at the microphone of the hearing aid is generally required, involving probe tube measurements, or a sound level meter (SLM). Regardless of the particular method used, conventional fitting generally requires clinical settings to employ specialized instruments for administration by trained hearing professionals. Throughout this application, the term "consumer" generally refers to a person being fitted with a hearing device, thus may be interchangeable with any of the terms "user," "person," "client," "hearing impaired," etc.

Furthermore, the term "hearing device" is herein used to refer to all types of hearing enhancement devices, including hearing aids prescribed for hearing impairment and personal sound amplification products (PSAP) generally not requiring a prescription or a medical waiver or any sound isolation earphone with an ear canal microphone, ambient sound microphone and a speaker.

According to one aspect of the invention, a method is provided to determine a dynamic range compression function, to process audio reproduced by an earphone device.

A method is provided to acquire the DRCF using a portable computing device. In one embodiment, the portable computing device includes an audio processing component coupled with an audio output device and a user input interface, and operatively coupled to an earphone device via either a wired or wireless audio connection. The method (called an "DRCF test") can be performed by carrying out the following operations:—receiving a selected audio content signal at the audio input device, for instant music audio selected from a user's media liberty or remote music streaming server; determining if the frequency content of the received audio signal is suitable for conducting a DRCF test; filtering the received audio signal using at least one of a group of filters, each with separate center frequencies, to split the input audio data into a number of frequency bands to generate at least one filtered signals; determining if ambient sound conditions are suitable for a DRCF test; determining the sensitivity of a presentation loudspeaker; presenting each of the filtered signals to a user with the earphone at a first sound pressure level and for each presentation: determining the minimum presentation level at which the user can hear the presented filtered signal; and generate a DRCF curve.

At least one further embodiment is directed to a method of calibrating the earphone for administering the DRCF test. The method uses an ear canal microphone signal from the earphone to measure the frequency dependent level in response to an emitted test signal.

At least one further embodiment is directed to a method to determine if ambient sound conditions are suitable for a DRCF test. The method uses a microphone proximal to the user's ear, such as an ambient sound microphone or ear canal microphone on the earphone that is used to administer the test.

At least one further embodiment is directed to a method to determine if the earphone is fitted correctly in the ear prior to conducting a DRCF test. The method uses an ear canal microphone to test the ear seal integrity produced by the earphone.

At least one exemplary embodiment of the invention is directed to an earpiece for speech intelligibility enhancement. Reference is made to FIG. 1 in which an earpiece device, indicated as earpiece 100, is constructed and operates in accordance with at least one exemplary embodiment of the invention. As illustrated, earpiece 100 depicts an electroacoustic assembly 113 for an in-the-ear acoustic assembly and wire 119 (if wired), where a portion of the assembly 113 is typically placed in the ear canal 131 of a user 135. The earpiece 100 can be an in the ear earpiece, or other suitable earpiece type. The earpiece 100 can be partially or fully occluded in the ear canal 131.

Earpiece 100 includes an Ambient Sound Microphone (ASM) 111 to capture ambient sound, an Ear Canal Receiver (loudspeaker) 125 to deliver audio to an ear canal 131, and an Ear Canal Microphone 123 to detect sound pressure closer to the tympanic membrane 133 compare to that measured by the ASM, an ear seal mechanism 127 to create an occluded space in the ear canal 129.

The earpiece 100 can partially or fully occlude the ear canal 131 to provide various degrees of acoustic isolation with an ear seal. The ear seal 127 is typically made from a foam, soft rubber or balloon material and serves to reduce the transmission of ambient sound into the occluded ear canal.

The microphones 123, 111, and loudspeaker 123, are operatively connected to a digital signal processing device 121, a DSP. The DSP can contain a wireless transceiver to connect with a portable computing device, such as a mobile phone, and optionally connected to another earphone via wire 119.

Figure 2:
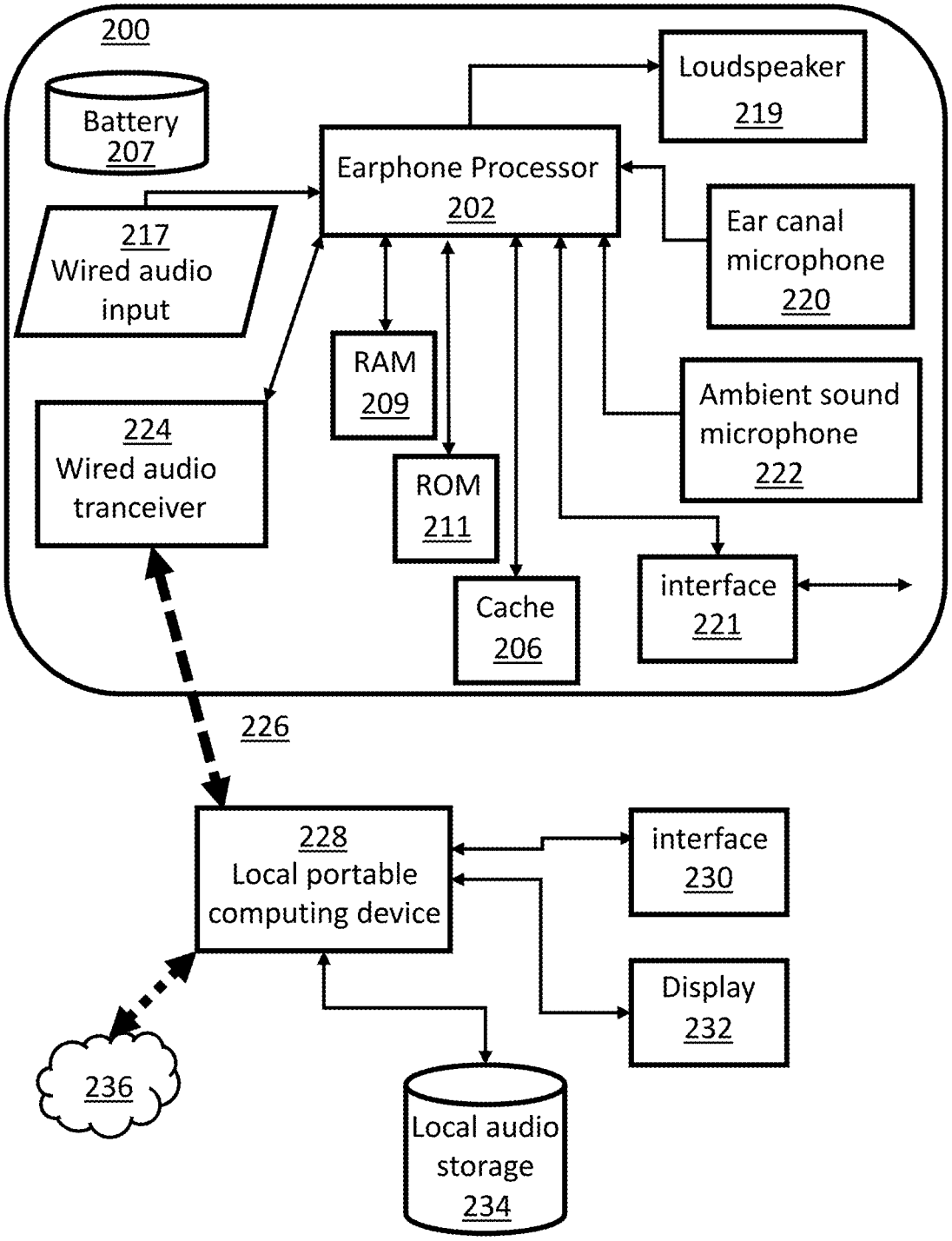
FIG. 2 shows a block diagram of an earpiece system in accordance with the described embodiments.

FIG. 2 is a block diagram of an electronic earphone device suitable for use with at least one of the described embodiments. The electronic device 200 illustrates circuitry of a representative computing device. The electronic device 200 includes a processor 202 that pertains to a Digital Signal Processor (DSP) device or microprocessor or controller for controlling the overall operation of the electronic device 200. For example, processor 202 can be used to receive a wireless 224 or wired 217 audio input signal. The electronic device 200 can also include a cache 206. The cache 206 is, for example, Random Access Memory (RAM) provided by semiconductor memory. The relative access time to the cache 206 is substantially shorter than for the system RAM 209.

The electronic device 200 is powered by a battery 207. The electronic device 200 can also include the RAM 209 and a Read-Only Memory (ROM) 211. The ROM 211 can store programs, utilities or processes to be executed in a non-volatile manner.

The speaker 219 is an ear canal loudspeaker, also often referred to as a receiver. Microphone 220 can be used to detect audible sound in the ear canal (ear canal microphone). A second microphone 222 can be used to detect audible sound in the ambient environment (ambient sound microphone).

An optional interface 221 on the earphone device 200 can be used for user input, such as a capacitive touch sensor.

A wireless audio and data transceiver unit 224 connects with a computing device 228 (e.g., a local portable computing device). The wireless connection 226 can be any electromagnetic connection, for example via Bluetooth or Wi-Fi or magnetic induction, and transmits audio and control data. The local portable computing device 228 can be a mobile phone, tablet, television, gaming hardware unit or other similar hardware devices.

The local portable computing device 228 utilizes a user interface 230 and display 232, such as a touch screen or buttons, and can be connected to the cloud 236 to receive and stream audio. Alternatively, audio can be replayed to the earphone device 200 from storage 234 on the computing device 228.

Figure 3:
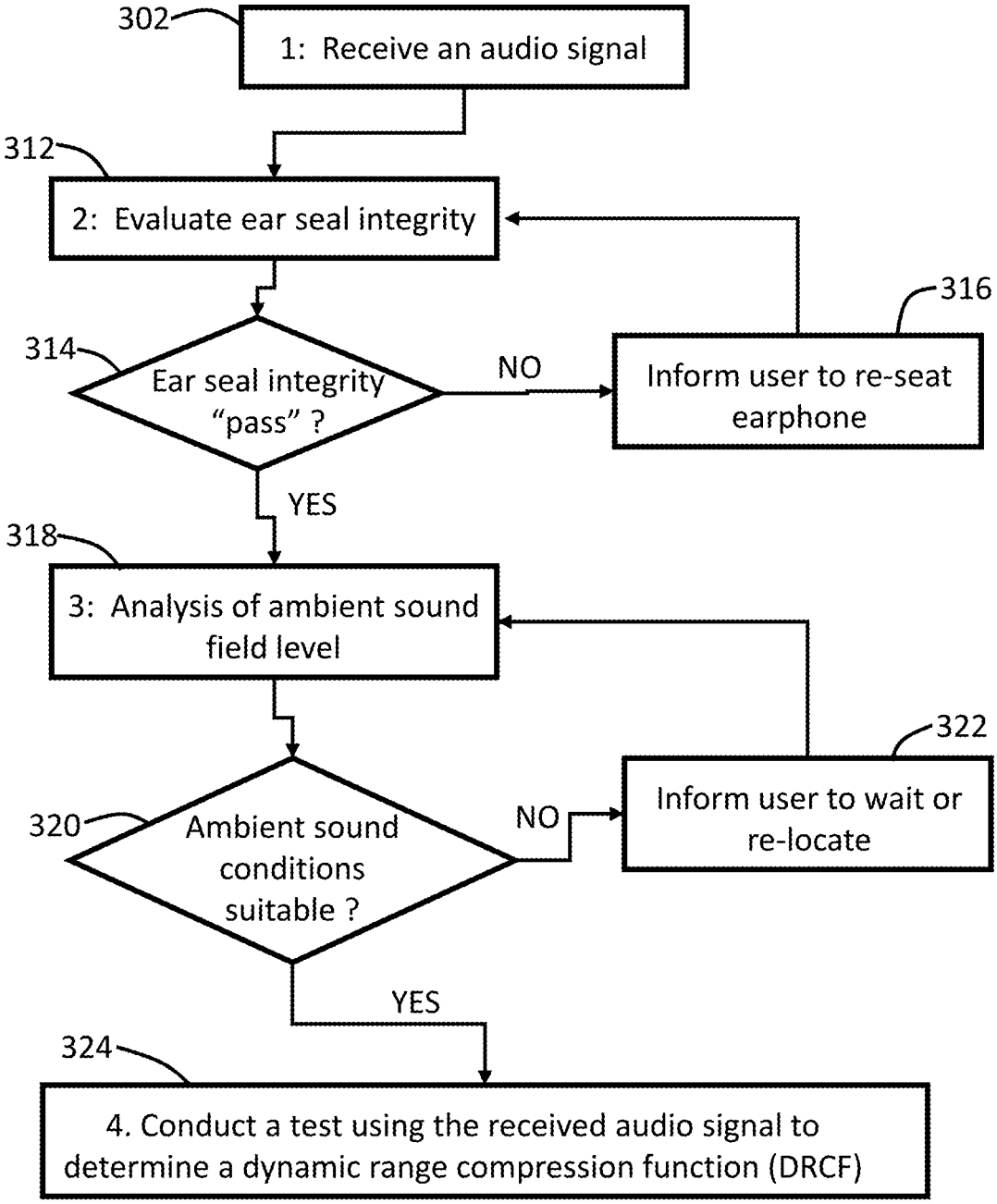
FIG. 3 shows a flow chart detailing an exemplary method for obtaining a DRCF.

FIG. 3 shows a flow chart for acquiring a Dynamic Range Compression Function (DRCF) for a user comprising the following exemplary steps (this process is called a "DRCF test"):

Step 1, 302: Selecting an audio signal: The audio signal is typically speech audio stored on a portable computing device communicatively coupled with the earphone device via a wired or wireless audio means (e.g. Bluetooth). Alternatively, the audio signal is stored on a remote web based server in "the cloud" 236 and is streamed to the portable computing device 228 via wireless means, e.g. via Wi-Fi or a wireless telephone data link. The user can manually select the audio file to be reproduced via a graphical user interface 230, 232 on the portable computing device 228.

Step 2, 312: Determining if the earphone used for determining the DRCF is correctly fitted by an analysis of the earphone ear seal (this method is described in FIG. 5). If the ear seal is determined not to be a good fit 314, then the user is informed 316 that the ear seal test is not optimal and prompted to adjust that earphone to attain a good seal, and the ear seal test is repeated.

Step 3, 318: (An optional step): Determining if ambient sound conditions are suitable for a DRCF test. In one exemplary embodiment, this is accomplished by measuring the frequency dependent ambient sound pressure level using the earphone microphone or microphone operatively attached to the local portable computing device. The measured frequency dependent ambient sound pressure level curve is compared to a reference frequency dependent ambient sound pressure level curve, and if the measured curve is less than the reference curve for any frequency value, then the ambient sound conditions are determined to not be suitable. In such an unsuitable case, the user is informed 322 that they should re-locate to a quieter ambient environment.

Step 4, 324: Conduct a DRCF test using the received audio content signal to determine a DRCF. This method is described in FIG. 5.

The DRCF curve can be updated by averaging multiple DRCF curves generated using prior DRCF tests, and where the prior DRCF tests may be undertaken using different presentation audio stimuli.

In one exemplary embodiment, a DRCF curve is determined separately for speech audio signals and for music audio signals.

Figure 4:
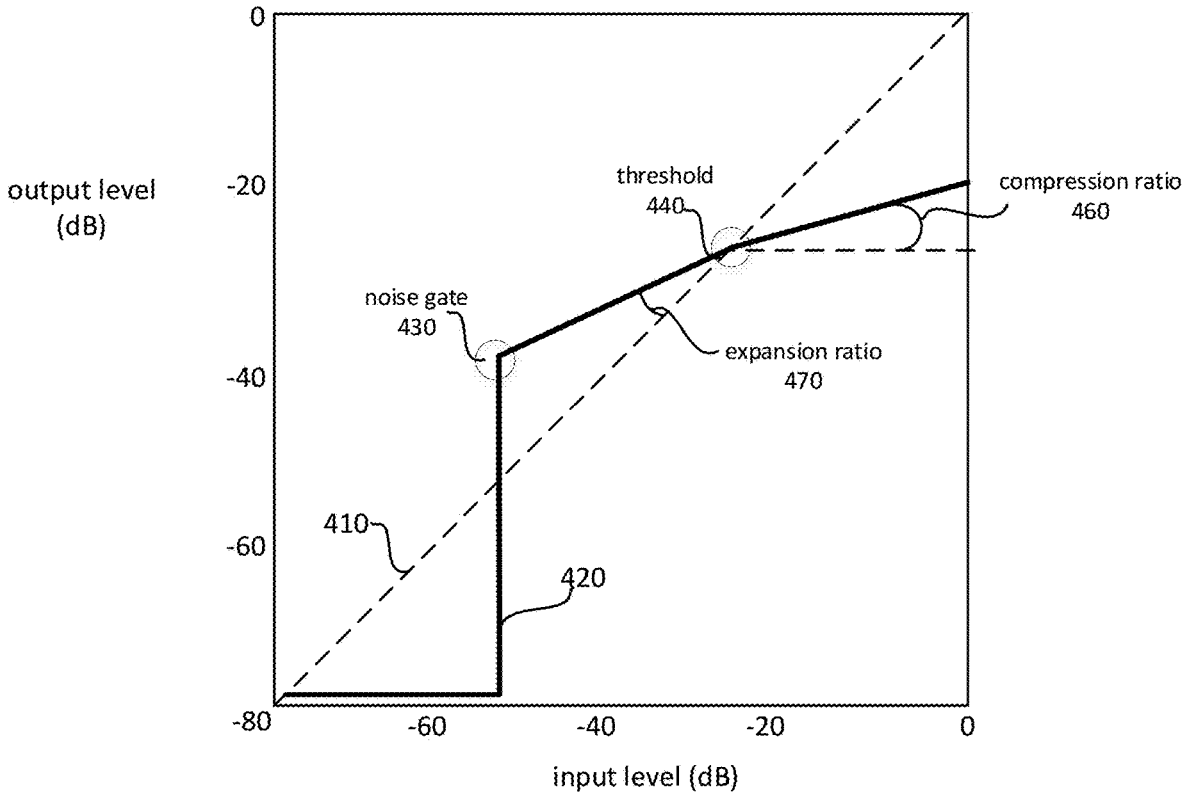
FIG. 4 shows a typical dynamic range compression function curve.

FIG. 4 shows a typical Dynamic Range Compression function curve, as would be familiar to those skilled in the art. The graph shows how an input signal level is modified by an audio signal dynamic range compressor. The audio input signal level is shown on the x axis, in dB, and the output signal level on the y axis, for instance in dB relative to full-scale level in the digital system. The output signal is substantially attenuated when the input signal level is below the noise gate level 430, and is substantially attenuated when the signal level is greater than the threshold level 440. When the input signal level is between the noise gate level 430 and the threshold level 440, the signal level is boosted, or expanded (a boost or expansion is used equivalently, and means to apply a signal gain equal to or greater than unity). The expansion gain is applied to the input signal when the level is between the noise gate level 430 and the threshold level 440. The expansion gain level is determined by the slope of the DRCF curve 470.

The ratio of the output level to input level for input signals with a level above the threshold 440 is defined as the compression ratio 470, which can be defined as the slope of the input-output curve for input signals with a level greater than the threshold value 440.

Figure 5:
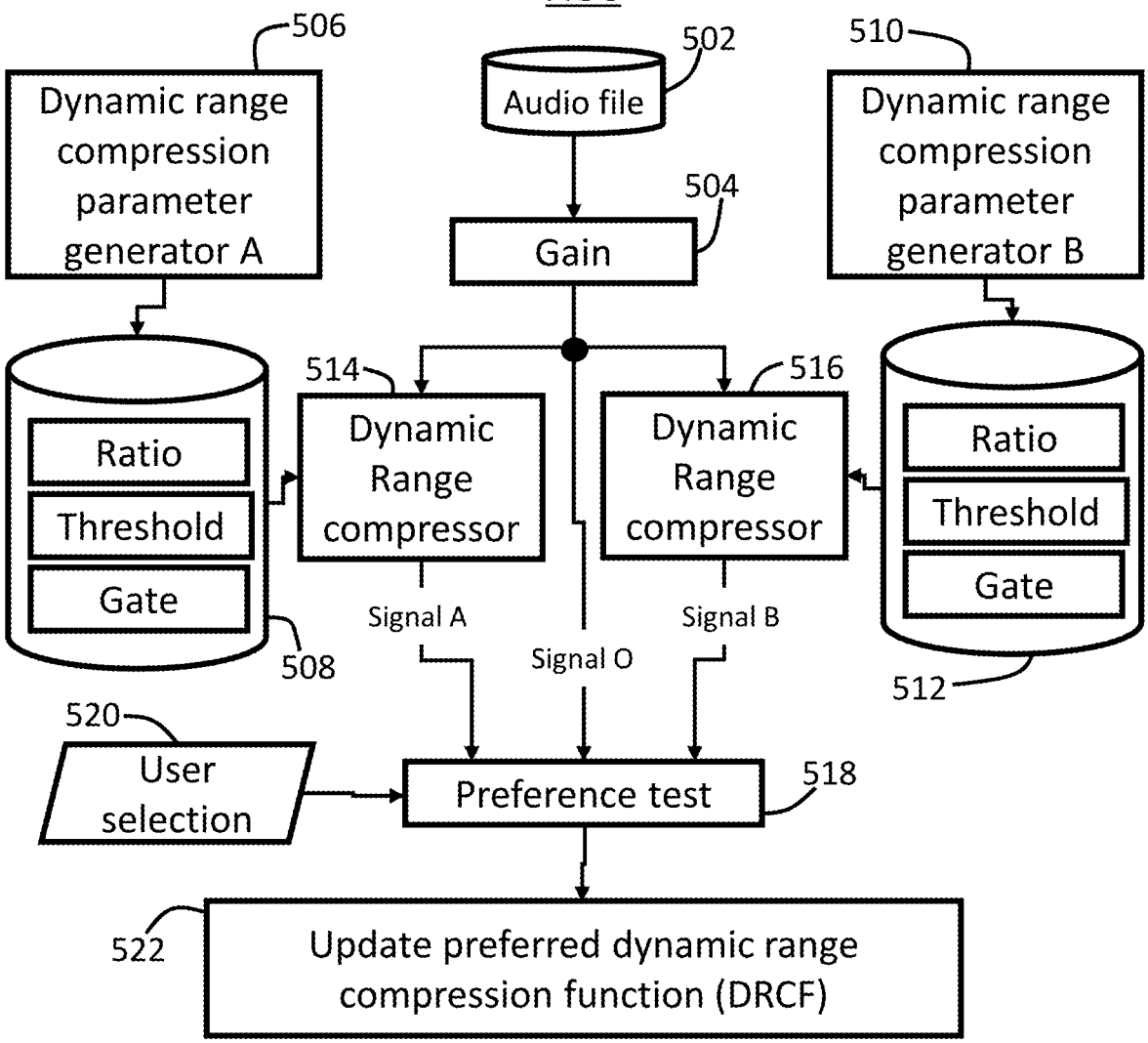
FIG. 5 shows a detailed exemplary method to generate a DRCF.

FIG. 5 shows a detailed exemplary method to generate a DRCF curve to optimize speech intelligibility, and comprises the steps of:

1. 502 Receiving a selected audio signal to the earphone DSP. The audio signal is reproduced from a digital storage file, and may be a speech or music audio signal.

2. 504 Applying a gain to the received audio signal to generate a modified input audio signal.

3. 506 Generating a first dynamic range compression parameter set A, where the parameters comprise a compression ratio value, an expansion ratio value, threshold value, and gate value 508.

4. 510 Generating a second dynamic range compression parameter set B, where the parameters also comprise a compression ratio value, an expansion ratio value, threshold value, and gate value 512.

5. The modified input signal is processed with a first dynamic range compressor using the DRC parameter set A 514 to produce an output signal A.

6. The modified input signal is processed with a first dynamic range compressor using the DRC parameter set B 516 to produce an output signal B.

7. A preference test is conducted 518 by the user with a user selection interface 520. The preference test can be in the form of a standard paired comparison AB test, where two audio signals are presented A and B, A and O, or B and O, and the user determines which signal they prefer. In one exemplary embodiment, the user is asked to determine which signal, A or B, sounds the clearest in terms of speech intelligibility. Using this methodology, an optimum DRCF can be determined that optimizes speech intelligibility.

To generate the different DRC parameters, the noise gate, threshold and compression and expansion ratio values are changed independently to determine optimal values that are subjectively chosen by a listener to give enhanced speech intelligibility. In one exemplary embodiment, the three values are modified independently, for instance, the noise gate value is chosen to be either −40; −60; and −70 dB; and the threshold value is chosen to be either −10; −15 or −20 dB; and the compression ratio is chosen to be 1; 0.5 or 0.25 and the expansion ratio is chosen to be 1; 2 or 3. With a full factorial preference test, this gives 3*3*3*3=81 unique parameter configurations to determine the preferred DRCF for a given audio input signal at a given gain. The test can then be repeated using a different input audio signal.

Using the methodology of FIG. 5, the initial DRC parameter set A uses an arbitrary (i.e. randomly chosen) set of initial parameters, e.g. with a noise gate at −60 dB, a threshold value at −10 dB, a compression ratio of 0.5 and an expansion ration of 2.0.

The optimal DRCF will be determined by user selection, or by tracking the number of times the user replaces DRCF (n) and DRCF(n+1), or by tracking the latency of responding to which DRCF (that is, DRCF(n) vs. DRCF(n+1)) is preferred.

The method presented in FIG. 5 can be modified to determine a frequency dependent DRCF by first band pass filtering the input audio signal and applying different DRCFs to each frequency band, but in the preferred embodiment a single broad band DRCF is used, i.e. in the preferred embodiment, there is a single DRCF curve that is used to process the input audio signal.

Figure 6:
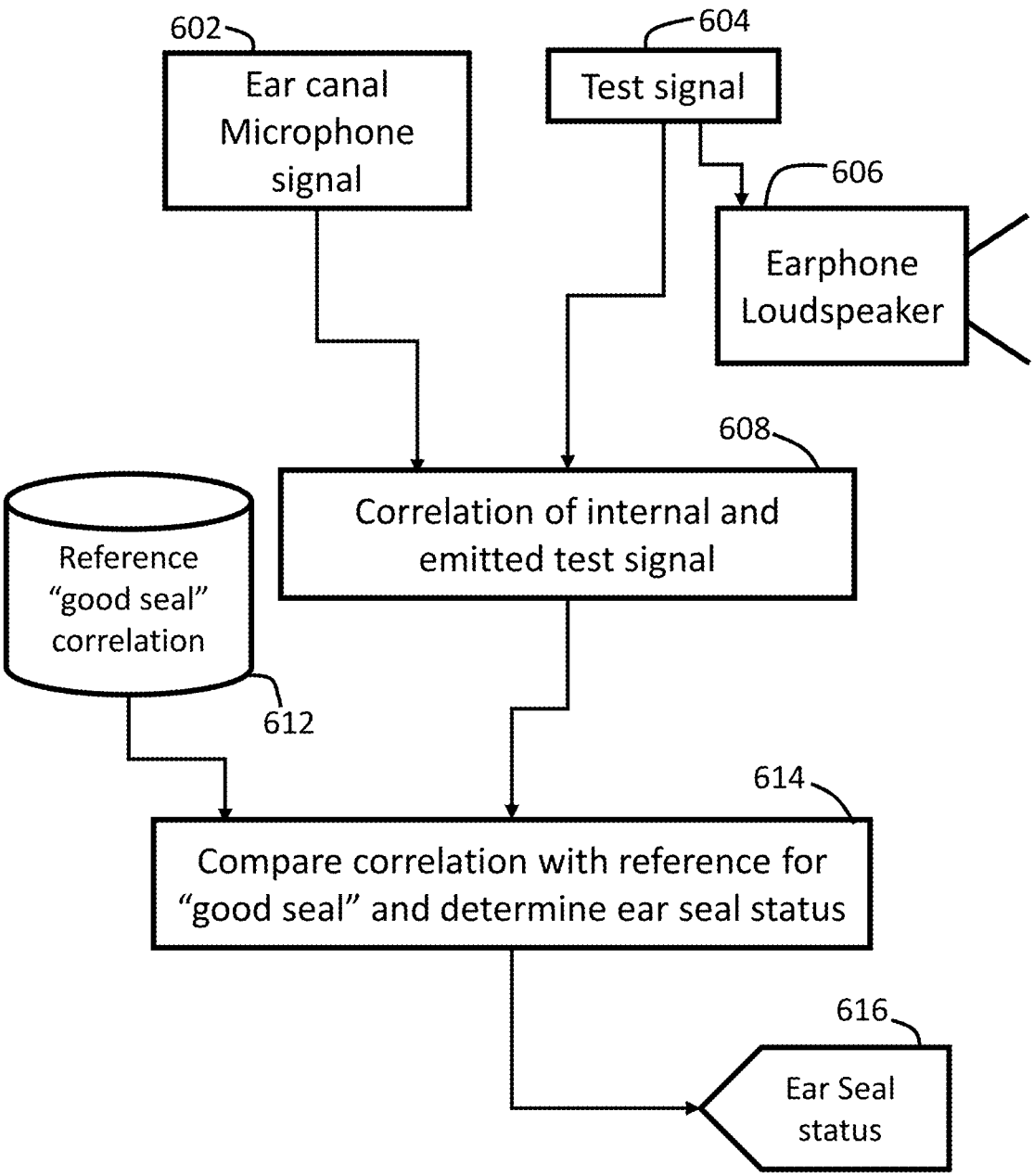
FIG. 6 shows a flow chart detailing an exemplary method to determine if the ear seal is sufficient to conduct a DRCF test.

FIG. 6 shows a flow chart detailing an exemplary method to determine if the ear seal of an earphone is sufficient to conduct a DRCF test.

In the preferred embodiment, the method to determine if the earphone used for administering the DRCF test is correctly fitted comprises the steps of:

Step 1: 602. Emitting a test signal with earphone loudspeaker 606, located within a left or right, or both left and right ear(s) of a user. In one exemplary embodiment, the emitted test signal is a 5 second chirp signal (i.e. exponential swept sine wave signal) between 30 Hz and 60 Hz. The signal can be generated using earphone processor 202.

Step 2: 608. Correlating an ear canal microphone signal in the left, right or both left and right ear(s) of the user with the emitted test signal to give a measured average cross-correlation magnitude.

Step 3: 614. Comparing the measured average cross-correlation magnitude with a threshold correlation value 612 to determine ear seal integrity (for example, if the maximum value of the correlation is greater than 0.7, we determine the signals are correlated). In one exemplary embodiment, the comparison is a ratio of the measured average cross-correlation magnitude divided by a reference scaler value, where the reference scaler value is the measured average cross-correlation magnitude for a known good ear seal. In such an exemplary embodiment, if the ratio value is greater than unity, then the seal integrity is determined to be "good", i.e. "pass", and "bad" i.e. "fail" otherwise.

If the determined seal integrity is a "fail", the user is informed 616 that the ear seal is not good and to re-seat the earphone sealing unit in the ear canal, and repeat the ear seal test. The user can be informed by a visual display message on the operatively connected mobile computing device.

Figure 7:
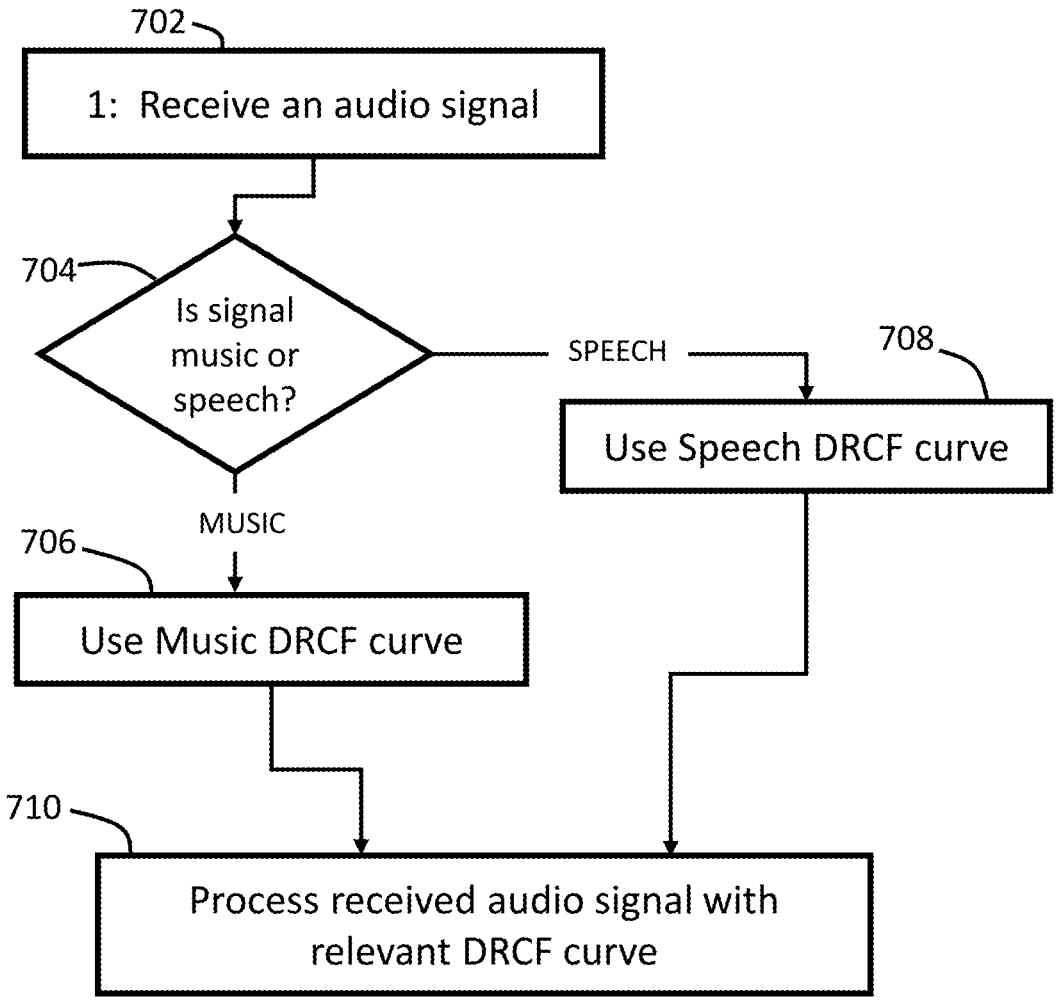
FIG. 7 shows a flow chart detailing a method of processing an audio signal.

FIG. 7 shows a method of the present invention for processing a received speech or music audio signal with a respective speech or music DRCF curve—i.e. a speech DRCF curve is obtained when the test signal to determine the preferred DRCF curve is speech (i.e. the audio signal 502 in FIG. 5). The steps of the method are as follows:

Receive an audio signal 702. The audio signal may be streamed from a remote music server 236 or stored on local data storage 234.

Determining if the received audio signal 702 is a speech or music audio signal. Meta-data associated with the audio signal 702 typically can be used to determine if the signal is speech or music audio.

708: If the received audio signal 702 is speech, the signal 702 is processed 710 with a DRC curve obtained using speech test signals.

706: If the received audio signal 702 is music, the received signal 702 is processed 710 with a DRC curve obtained using music test signals.

The received audio signal 702 is processed with the DRC function in a way familiar to those skilled in the art:

First, a level estimate of the input signal is determined. The level estimate can be taken as a short term running average of the input signal. The level estimate can be taken from a frequency filtered signal, e.g. using a band pass filter that attenuates upper and lower frequencies, e.g. according to the well-known A-weighting function. The running average is typically taken over a window length of approximately 200 ms.

Second, a gain is applied to the input signal based. The gain is dependent on the estimated input signal level and maps to an output signal according to the particular input-output DRCF curve, as shown in FIG. 4. The rate of gain change can be time smoothed, and the rate of increase in gain can be different from the rate of gain decrease.

Figure 8:
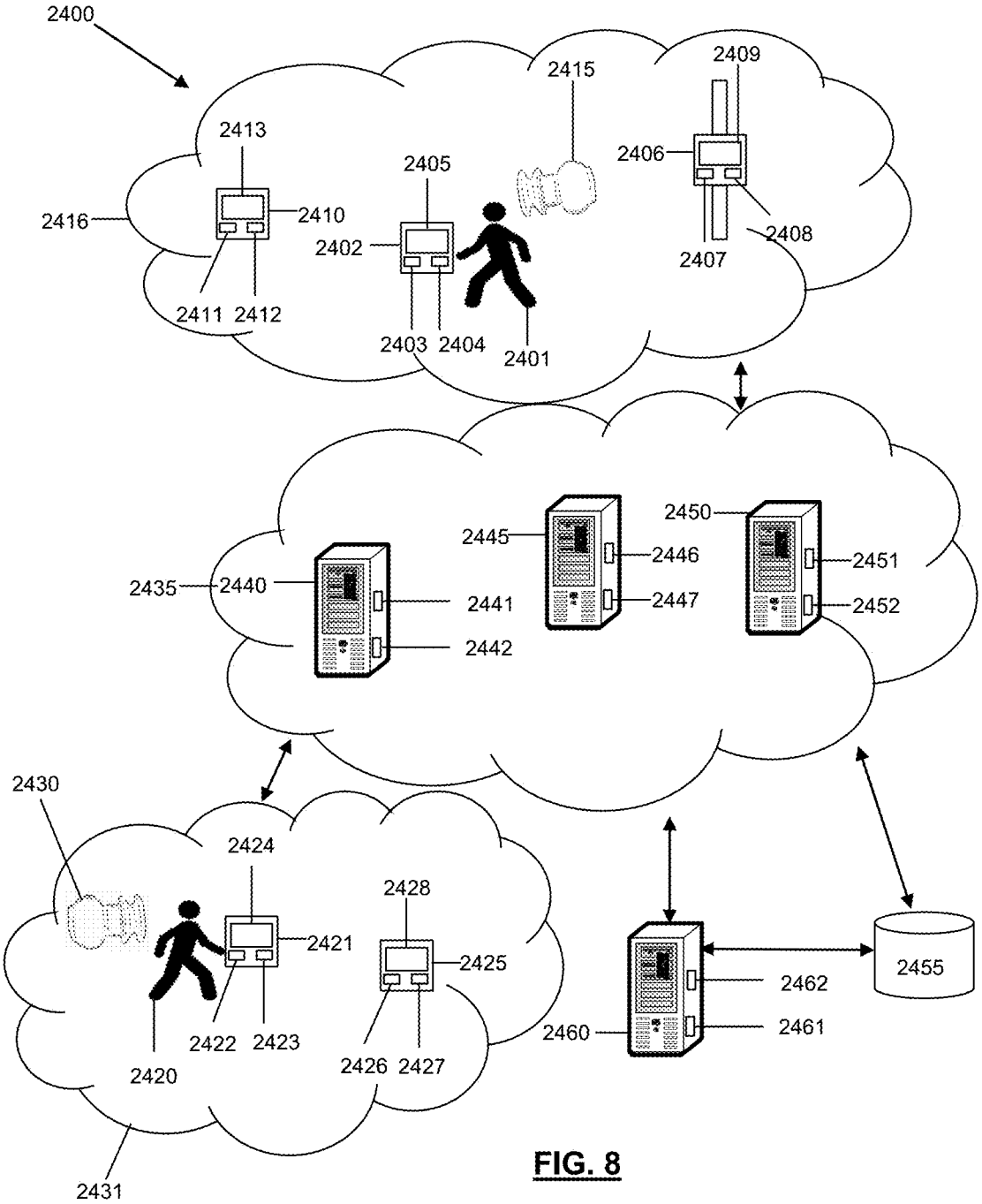
FIG. 8 is a schematic diagram of a system for utilizing eartips according to an embodiment of the present disclosure.

As shown in FIG. 8, a system 2400 and methods for utilizing eartips and/or earphone devices are disclosed.

The system 2400 may be configured to support, but is not limited to supporting, data and content services, audio processing applications and services, audio output and/or input applications and services, applications and services for transmitting and receiving audio content, authentication applications and services, computing applications and services, cloud computing services, internet services, satellite services, telephone services, software as a service (SaaS) applications, platform-as-a-service (PaaS) applications, gaming applications and services, social media applications and services, productivity applications and services, voice-over-internet protocol (VoIP) applications and services, speech-to-text translation applications and services, interactive voice applications and services, mobile applications and services, and any other computing applications and services. The system may include a first user 2401, who may utilize a first user device 2402 to access data, content, and applications, or to perform a variety of other tasks and functions. As an example, the first user 2401 may utilize first user device 2402 to access an application (e.g. a browser or a mobile application) executing on the first user device 2402 that may be utilized to access web pages, data, and content associated with the system 2400. In certain embodiments, the first user 2401 may be any type of user that may potentially desire to listen to audio content, such as from, but not limited to, a music playlist accessible via the first user device 2402, a telephone call that the first user 2401 is participating in, audio content occurring in an environment in proximity to the first user 2401, any other type of audio content, or a combination thereof. For example, the first user 2401 may be an individual that may be participating in a telephone call with another user, such as second user 2420.

The first user device 2402 utilized by the first user 2401 may include a memory 2403 that includes instructions, and a processor 2404 that executes the instructions from the memory 2403 to perform the various operations that are performed by the first user device 2402. In certain embodiments, the processor 2404 may be hardware, software, or a combination thereof. The first user device 2402 may also include an interface 2405 (e.g. screen, monitor, graphical user interface, etc.) that may enable the first user 2401 to interact with various applications executing on the first user device 2402, to interact with various applications executing within the system 2400, and to interact with the system 2400 itself. In certain embodiments, the first user device 2402 may include any number of transducers, such as, but not limited to, microphones, speakers, any type of audio-based transducer, any type of transducer, or a combination thereof. In certain embodiments, the first user device 2402 may be a computer, a laptop, a tablet device, a phablet, a server, a mobile device, a smartphone, a smart watch, and/or any other type of computing device. Illustratively, the first user device 2402 is shown as a mobile device in FIG. 24. The first user device 2402 may also include a global positioning system (GPS), which may include a GPS receiver and any other necessary components for enabling GPS functionality, accelerometers, gyroscopes, sensors, and any other componentry suitable for a mobile device.

In addition to using first user device 2402, the first user 2401 may also utilize and/or have access to a second user device 2406 and a third user device 2410. As with first user device 2402, the first user 2401 may utilize the second and third user devices 2406, 2410 to transmit signals to access various online services and content. The second user device 2406 may include a memory 2407 that includes instructions, and a processor 2408 that executes the instructions from the memory 2407 to perform the various operations that are performed by the second user device 2406. In certain embodiments, the processor 2408 may be hardware, software, or a combination thereof. The second user device 2406 may also include an interface 2409 that may enable the first user 2401 to interact with various applications executing on the second user device 2406 and to interact with the system 2400. In certain embodiments, the second user device 2406 may include any number of transducers, such as, but not limited to, microphones, speakers, any type of audio-based transducer, any type of transducer, or a combination thereof. In certain embodiments, the second user device 2406 may be and/or may include a computer, any type of sensor, a laptop, a set-top-box, a tablet device, a phablet, a server, a mobile device, a smartphone, a smart watch, and/or any other type of computing device. Illustratively, the second user device 2402 is shown as a smart watch device in FIG. 24.

The third user device 2410 may include a memory 2411 that includes instructions, and a processor 2412 that executes the instructions from the memory 2411 to perform the various operations that are performed by the third user device 2410. In certain embodiments, the processor 2412 may be hardware, software, or a combination thereof. The third user device 2410 may also include an interface 2413 that may enable the first user 2401 to interact with various applications executing on the second user device 2406 and to interact with the system 2400. In certain embodiments, the third user device 2410 may include any number of transducers, such as, but not limited to, microphones, speakers, any type of audio-based transducer, any type of transducer, or a combination thereof. In certain embodiments, the third user device 2410 may be and/or may include a computer, any type of sensor, a laptop, a set-top-box, a tablet device, a phablet, a server, a mobile device, a smartphone, a smart watch, and/or any other type of computing device. Illustratively, the third user device 2410 is shown as a smart watch device in FIG. 24.

The first, second, and/or third user devices 2402, 2406, 2410 may belong to and/or form a communications network 2416. In certain embodiments, the communications network 2416 may be a local, mesh, or other network that facilitates communications among the first, second, and/or third user devices 2402, 2406, 2410 and/or any other devices, programs, and/or networks of system 2400 or outside system 2400. In certain embodiments, the communications network 2416 may be formed between the first, second, and third user devices 2402, 2406, 2410 through the use of any type of wireless or other protocol and/or technology. For example, the first, second, and third user devices 2402, 2406, 2410 may communicate with one another in the communications network 2416, such as by utilizing Bluetooth Low Energy (BLE), classic Bluetooth, ZigBee, cellular, NFC, Wi-Fi, Z-Wave, ANT+, IEEE 802.15.4, IEEE 802.22, ISA100a, infrared, ISM band, RFID, UWB, Wireless HD, Wireless USB, any other protocol and/or wireless technology, satellite, fiber, or any combination thereof. Notably, the communications network 2416 may be configured to communicatively link with and/or communicate with any other network of the system 2400 and/or outside the system 2400.

The system 2400 may also include an earphone device 2415, which the first user 2401 may utilize to hear and/or audition audio content, transmit audio content, receive audio content, experience any type of content, process audio content, adjust audio content, store audio content, perform any type of operation with respect to audio content, or a combination thereof. The earphone device 2415 may be an earpiece, a hearing aid, an ear monitor, an ear terminal, a behind-the-ear device, any type of acoustic device, or a combination thereof. The earphone device 2415 may include any type of component utilized for any type of earpiece. In certain embodiments, the earphone device 2415 may include any number of ambient sound microphones that may be configured to capture and/or measure ambient sounds and/or audio content occurring in an environment that the earphone device 2415 is present in and/or is proximate to. In certain embodiments, the ambient sound microphones may be placed at a location or locations on the earphone device 2415 that are conducive to capturing and measuring ambient sounds occurring in the environment. For example, the ambient sound microphones may be positioned in proximity to a distal end (e.g. the end of the earphone device 2415 that is not inserted into the first user's 2401 ear) of the earphone device 2415 such that the ambient sound microphones are in an optimal position to capture ambient or other sounds occurring in the environment. In certain embodiments, the earphone device 2415 may include any number of ear canal microphones, which may be configured to capture and/or measure sounds occurring in an ear canal of the first user 2401 or other user wearing the earphone device 2415. In certain embodiments, the ear canal microphones may be positioned in proximity to a proximal end (e.g. the end of the earphone device 2415 that is inserted into the first user's 2401 ear) of the earphone device 2415 such that sounds occurring in the ear canal of the first user 2401 may be captured more readily.

The earphone device 2415 may also include any number of transceivers, which may be configured transmit signals to and/or receive signals from any of the devices in the system 2400. In certain embodiments, a transceiver of the earphone device 2415 may facilitate wireless connections and/or transmissions between the earphone device 2415 and any device in the system 2400, such as, but not limited to, the first user device 2402, the second user device 2406, the third user device 2410, the fourth user device 2421, the fifth user device 2425, the earphone device 2430, the servers 2440, 2445, 2450, 2460, and the database 2455. The earphone device 2415 may also include any number of memories for storing content and/or instructions, processors that execute the instructions from the memories to perform the operations for the earphone device 2415, and/or any type integrated circuit for facilitating the operation of the earphone device 2415. In certain embodiments, the processors may comprise, hardware, software, or a combination of hardware and software. The earphone device 2415 may also include one or more ear canal receivers, which may be speakers for outputting sound into the ear canal of the first user 2401. The ear canal receivers may output sounds obtained via the ear canal microphones, ambient sound microphones, any of the devices in the system 2400, from a storage device of the earphone device 2415, or any combination thereof.

The ear canal receivers, ear canal microphones, transceivers, memories, processors, integrated circuits, and/or ear canal receivers may be affixed to an electronics package that includes a flexible electronics board. The earphone device 2415 may include an electronics packaging housing that may house the ambient sound microphones, ear canal microphones, ear canal receivers (i.e. speakers), electronics supporting the functionality of the microphones and/or receivers, transceivers for receiving and/or transmitting signals, power sources (e.g. batteries and the like), any circuitry facilitating the operation of the earphone device 2415, or any combination thereof. The electronics package including the flexible electronics board may be housed within the electronics packaging housing to form an electronics packaging unit. The earphone device 2415 may further include an earphone housing, which may include receptacles, openings, and/or keyed recesses for connecting the earphone housing to the electronics packaging housing and/or the electronics package. For example, nozzles of the electronics packaging housing may be inserted into one or more keyed recesses of the earphone housing so as to connect and secure the earphone housing to the electronics packaging housing. When the earphone housing is connected to the electronics packaging housing, the combination of the earphone housing and the electronics packaging housing may form the earphone device 2415. The earphone device 2415 may further include a cap for securing the electronics packaging housing, the earphone housing, and the electronics package together to form the earphone device 2415.

In certain embodiments, the earphone device 2415 may be configured to have any number of changeable tips, which may be utilized to facilitate the insertion of the earphone device 2415 into an ear aperture of an ear of the first user 2401, secure the earphone device 2415 within the ear canal of an ear of the first user 2401, and/or to isolate sound within the ear canal of the first user 2401. The tips may be foam tips, which may be affixed onto an end of the earphone housing of the earphone device 2415, such as onto a stent and/or attachment mechanism of the earphone housing. In certain embodiments, the tips may be any type of eartip as disclosed and described in the present disclosure.

In addition to the first user 2401, the system 2400 may include a second user 2420, who may utilize a fourth user device 2421 to access data, content, and applications, or to perform a variety of other tasks and functions. Much like the first user 2401, the second user 2420 may be may be any type of user that may potentially desire to listen to audio content, such as from, but not limited to, a storage device of the fourth user device 2421, a telephone call that the second user 2420 is participating in, audio content occurring in an environment in proximity to the second user 2420, any other type of audio content, or a combination thereof. For example, the second user 2420 may be an individual that may be listening to songs stored in a playlist that resides on the fourth user device 2421. Also, much like the first user 2401, the second user 2420 may utilize fourth user device 2421 to access an application (e.g. a browser or a mobile application) executing on the fourth user device 2421 that may be utilized to access web pages, data, and content associated with the system 2400. The fourth user device 2421 may include a memory 2422 that includes instructions, and a processor 2423 that executes the instructions from the memory 2422 to perform the various operations that are performed by the fourth user device 2421. In certain embodiments, the processor 2423 may be hardware, software, or a combination thereof. The fourth user device 2421 may also include an interface 2424 (e.g. a screen, a monitor, a graphical user interface, etc.) that may enable the second user 2420 to interact with various applications executing on the fourth user device 2421, to interact with various applications executing in the system 2400, and to interact with the system 2400. In certain embodiments, the fourth user device 2421 may include any number of transducers, such as, but not limited to, microphones, speakers, any type of audio-based transducer, any type of transducer, or a combination thereof. In certain embodiments, the fourth user device 2421 may be a computer, a laptop, a tablet device, a phablet, a server, a mobile device, a smartphone, a smart watch, and/or any other type of computing device. Illustratively, the fourth user device 2421 may be a computing device in FIG. 24. The fourth user device 2421 may also include any of the componentry described for first user device 2402, the second user device 2406, and/or the third user device 2410. In certain embodiments, the fourth user device 2421 may also include a global positioning system (GPS), which may include a GPS receiver and any other necessary components for enabling GPS functionality, accelerometers, gyroscopes, sensors, and any other componentry suitable for a computing device.

In addition to using fourth user device 2421, the second user 2420 may also utilize and/or have access to a fifth user device 2425. As with fourth user device 2421, the second user 2420 may utilize the fourth and fifth user devices 2421, 2425 to transmit signals to access various online services and content. The fifth user device 2425 may include a memory 2426 that includes instructions, and a processor 2427 that executes the instructions from the memory 2426 to perform the various operations that are performed by the fifth user device 2425. In certain embodiments, the processor 2427 may be hardware, software, or a combination thereof. The fifth user device 2425 may also include an interface 2428 that may enable the second user 2420 to interact with various applications executing on the fifth user device 2425 and to interact with the system 2400. In certain embodiments, the fifth user device 2425 may include any number of transducers, such as, but not limited to, microphones, speakers, any type of audio-based transducer, any type of transducer, or a combination thereof. In certain embodiments, the fifth user device 2425 may be and/or may include a computer, any type of sensor, a laptop, a set-top-box, a tablet device, a phablet, a server, a mobile device, a smartphone, a smart watch, and/or any other type of computing device. Illustratively, the fifth user device 2425 is shown as a tablet device in FIG. 24.

The fourth and fifth user devices 2421, 2425 may belong to and/or form a communications network 2431. In certain embodiments, the communications network 2431 may be a local, mesh, or other network that facilitates communications between the fourth and fifth user devices 2421, 2425, and/or any other devices, programs, and/or networks of system 2400 or outside system 2400. In certain embodiments, the communications network 2431 may be formed between the fourth and fifth user devices 2421, 2425 through the use of any type of wireless or other protocol and/or technology. For example, the fourth and fifth user devices 2421, 2425 may communicate with one another in the communications network 2416, such as by utilizing BLE, classic Bluetooth, ZigBee, cellular, NFC, Wi-Fi, Z-Wave, ANT+, IEEE 802.15.4, IEEE 802.22, ISA100a, infrared, ISM band, RFID, UWB, Wireless HD, Wireless USB, any other protocol and/or wireless technology, satellite, fiber, or any combination thereof. Notably, the communications network 2431 may be configured to communicatively link with and/or communicate with any other network of the system 2400 and/or outside the system 2400.

Much like first user 2401, the second user 2420 may have his or her own earphone device 2430. The earphone device 2430 may be utilized by the second user 2420 to hear and/or audition audio content, transmit audio content, receive audio content, experience any type of content, process audio content, adjust audio content, store audio content, perform any type of operation with respect to audio content, or a combination thereof. The earphone device 2430 may be an earpiece, a hearing aid, an ear monitor, an ear terminal, a behind-the-ear device, any type of acoustic device, or a combination thereof. The earphone device 2430 may include any type of component utilized for any type of earpiece, and may include any of the features, functionality and/or components described and/or usable with earphone device 2415. For example, earphone device 2430 may include any number of transceivers, ear canal microphones, ambient sound microphones, processors, memories, housings, eartips, foam tips, flanges, any other component, or any combination thereof.

In certain embodiments, the first, second, third, fourth, and/or fifth user devices 2402, 2406, 2410, 2421, 2425 and/or earphone devices 2415, 2430 may have any number of software applications and/or application services stored and/or accessible thereon. For example, the first and second user devices 2402, 2411 may include applications for processing audio content, applications for playing, editing, transmitting, and/or receiving audio content, streaming media applications, speech-to-text translation applications, cloud-based applications, search engine applications, natural language processing applications, database applications, algorithmic applications, phone-based applications, product-ordering applications, business applications, e-commerce applications, media streaming applications, content-based applications, database applications, gaming applications, internet-based applications, browser applications, mobile applications, service-based applications, productivity applications, video applications, music applications, social media applications, presentation applications, any other type of applications, any types of application services, or a combination thereof. In certain embodiments, the software applications and services may include one or more graphical user interfaces so as to enable the first and second users 2401, 2420 to readily interact with the software applications. The software applications and services may also be utilized by the first and second users 2401, 2420 to interact with any device in the system 2400, any network in the system 2400 (e.g. communications networks 2416, 2431, 2435), or any combination thereof. For example, the software applications executing on the first, second, third, fourth, and/or fifth user devices 2402, 2406, 2410, 2421, 2425 and/or earphone devices 2415, 2430 may be applications for receiving data, applications for storing data, applications for auditioning, editing, storing and/or processing audio content, applications for receiving demographic and preference information, applications for transforming data, applications for executing mathematical algorithms, applications for generating and transmitting electronic messages, applications for generating and transmitting various types of content, any other type of applications, or a combination thereof. In certain embodiments, the first, second, third, fourth, and/or fifth user devices 2402, 2406, 2410, 2421, 2425 and/or earphone devices 2415, 2430 may include associated telephone numbers, internet protocol addresses, device identities, or any other identifiers to uniquely identify the first, second, third, fourth, and/or fifth user devices 2402, 2406, 2410, 2421, 2425 and/or earphone devices 2415, 2430 and/or the first and second users 2401, 2420. In certain embodiments, location information corresponding to the first, second, third, fourth, and/or fifth user devices 2402, 2406, 2410, 2421, 2425 and/or earphone devices 2415, 2430 may be obtained based on the internet protocol addresses, by receiving a signal from the first, second, third, fourth, and/or fifth user devices 2402, 2406, 2410, 2421, 2425 and/or earphone devices 2415, 2430 or based on profile information corresponding to the first, second, third, fourth, and/or fifth user devices 2402, 2406, 2410, 2421, 2425 and/or earphone devices 2415, 2430.

The system 2400 may also include a communications network 2435. The communications network 2435 may be under the control of a service provider, the first and/or second users 2401, 2420, any other designated user, or a combination thereof. The communications network 2435 of the system 2400 may be configured to link each of the devices in the system 2400 to one another. For example, the communications network 2435 may be utilized by the first user device 2402 to connect with other devices within or outside communications network 2435. Additionally, the communications network 2435 may be configured to transmit, generate, and receive any information and data traversing the system 2400. In certain embodiments, the communications network 2435 may include any number of servers, databases, or other componentry. The communications network 2435 may also include and be connected to a mesh network, a local network, a cloud-computing network, an IMS network, a VoIP network, a security network, a VoLTE network, a wireless network, an Ethernet network, a satellite network, a broadband network, a cellular network, a private network, a cable network, the Internet, an internet protocol network, MPLS network, a content distribution network, any network, or any combination thereof. Illustratively, servers 2440, 2445, and 2450 are shown as being included within communications network 2435. In certain embodiments, the communications network 2435 may be part of a single autonomous system that is located in a particular geographic region, or be part of multiple autonomous systems that span several geographic regions.

Notably, the functionality of the system 2400 may be supported and executed by using any combination of the servers 2440, 2445, 2450, and 2460. The servers 2440, 2445, and 2450 may reside in communications network 2435, however, in certain embodiments, the servers 2440, 2445, 2450 may reside outside communications network 2435. The servers 2440, 2445, and 2450 may provide and serve as a server service that performs the various operations and functions provided by the system 2400. In certain embodiments, the server 2440 may include a memory 2441 that includes instructions, and a processor 2442 that executes the instructions from the memory 2441 to perform various operations that are performed by the server 2440. The processor 2442 may be hardware, software, or a combination thereof. Similarly, the server 2445 may include a memory 2446 that includes instructions, and a processor 2447 that executes the instructions from the memory 2446 to perform the various operations that are performed by the server 2445. Furthermore, the server 2450 may include a memory 2451 that includes instructions, and a processor 2452 that executes the instructions from the memory 2451 to perform the various operations that are performed by the server 2450. In certain embodiments, the servers 2440, 2445, 2450, and 2460 may be network servers, routers, gateways, switches, media distribution hubs, signal transfer points, service control points, service switching points, firewalls, routers, edge devices, nodes, computers, mobile devices, or any other suitable computing device, or any combination thereof. In certain embodiments, the servers 2440, 2445, 2450 may be communicatively linked to the communications network 2435, the communications network 2416, the communications network 2431, any network, any device in the system 2400, any program in the system 2400, or any combination thereof.

The database 2455 of the system 2400 may be utilized to store and relay information that traverses the system 2400, cache content that traverses the system 2400, store data about each of the devices in the system 2400 and perform any other typical functions of a database. In certain embodiments, the database 2455 may be connected to or reside within the communications network 2435, the communications network 2416, the communications network 2431, any other network, or a combination thereof. In certain embodiments, the database 2455 may serve as a central repository for any information associated with any of the devices and information associated with the system 2400. Furthermore, the database 2455 may include a processor and memory or be connected to a processor and memory to perform the various operation associated with the database 2455. In certain embodiments, the database 2455 may be connected to the earphone devices 2415, 2430, the servers 2440, 2445, 2450, 2460, the first user device 2402, the second user device 2406, the third user device 2410, the fourth user device 2421, the fifth user device 2425, any devices in the system 2400, any other device, any network, or any combination thereof.

The database 2455 may also store information and metadata obtained from the system 2400, store metadata and other information associated with the first and second users 2401, 2420, store user profiles associated with the first and second users 2401, 2420, store device profiles associated with any device in the system 2400, store communications traversing the system 2400, store user preferences, store information associated with any device or signal in the system 2400, store information relating to patterns of usage relating to the first, second, third, fourth, and fifth user devices 2402, 2406, 2410, 2421, 2425, store audio content associated with the first, second, third, fourth, and fifth user devices 2402, 2406, 2410, 2421, 2425 and/or earphone devices 2415, 2430, store audio content and/or information associated with the audio content that is captured by the ambient sound microphones, store audio content and/or information associated with audio content that is captured by ear canal microphones, store any information obtained from any of the networks in the system 2400, store audio content and/or information associated with audio content that is outputted by ear canal receivers of the system 2400, store any information and/or signals transmitted and/or received by transceivers of the system 2400, store any device and/or capability specifications relating to the earphone devices 2415, 2430, store historical data associated with the first and second users 2401, 2415, store information relating to the size (e.g. depth, height, width, curvatures, etc.) and/or shape of the first and/or second user's 2401, 2420 ear canals and/or ears, store information identifying and or describing any eartip utilized with the earphone devices 2401, 2415, store device characteristics for any of the devices in the system 2400, store information relating to any devices associated with the first and second users 2401, 2420, store any information associated with the earphone devices 2415, 2430, store log on sequences and/or authentication information for accessing any of the devices of the system 2400, store information associated with the communications networks 2416, 2431, store any information generated and/or processed by the system 2400, store any of the information disclosed for any of the operations and functions disclosed for the system 2400 herewith, store any information traversing the system 2400, or any combination thereof. Furthermore, the database 2455 may be configured to process queries sent to it by any device in the system 2400.

The system 2400 may also include a software application, which may be configured to perform and support the operative functions of the system 2400, such as the operative functions of the first, second, third, fourth, and fifth user devices 2402, 2406, 2410, 2421, 2425 and/or the earphone devices 2415, 2430. In certain embodiments, the application may be a website, a mobile application, a software application, or a combination thereof, which may be made accessible to users utilizing one or more computing devices, such as the first, second, third, fourth, and fifth user devices 2402, 2406, 2410, 2421, 2425 and/or the earphone devices 2415, 2430. The application of the system 2400 may be accessible via an internet connection established with a browser program or other application executing on the first, second, third, fourth, and fifth user devices 2402, 2406, 2410, 2421, 2425 and/or the earphone devices 2415, 2430, a mobile application executing on the first, second, third, fourth, and fifth user devices 2402, 2406, 2410, 2421, 2425 and/or the earphone devices 2415, 2430, or through other suitable means. Additionally, the application may allow users and computing devices to create accounts with the application and sign-in to the created accounts with authenticating username and password log-in combinations. The application may include a custom graphical user interface that the first user 2401 or second user 2420 may interact with by utilizing a browser executing on the first, second, third, fourth, and fifth user devices 2402, 2406, 2410, 2421, 2425 and/or the earphone devices 2415, 2430. In certain embodiments, the software application may execute directly as an installed program on the first, second, third, fourth, and fifth user devices 2402, 2406, 2410, 2421, 2425 and/or the earphone devices 2415, 2430.

Computing System for Facilitating the Operation and Functionality of the System

Figure 9:
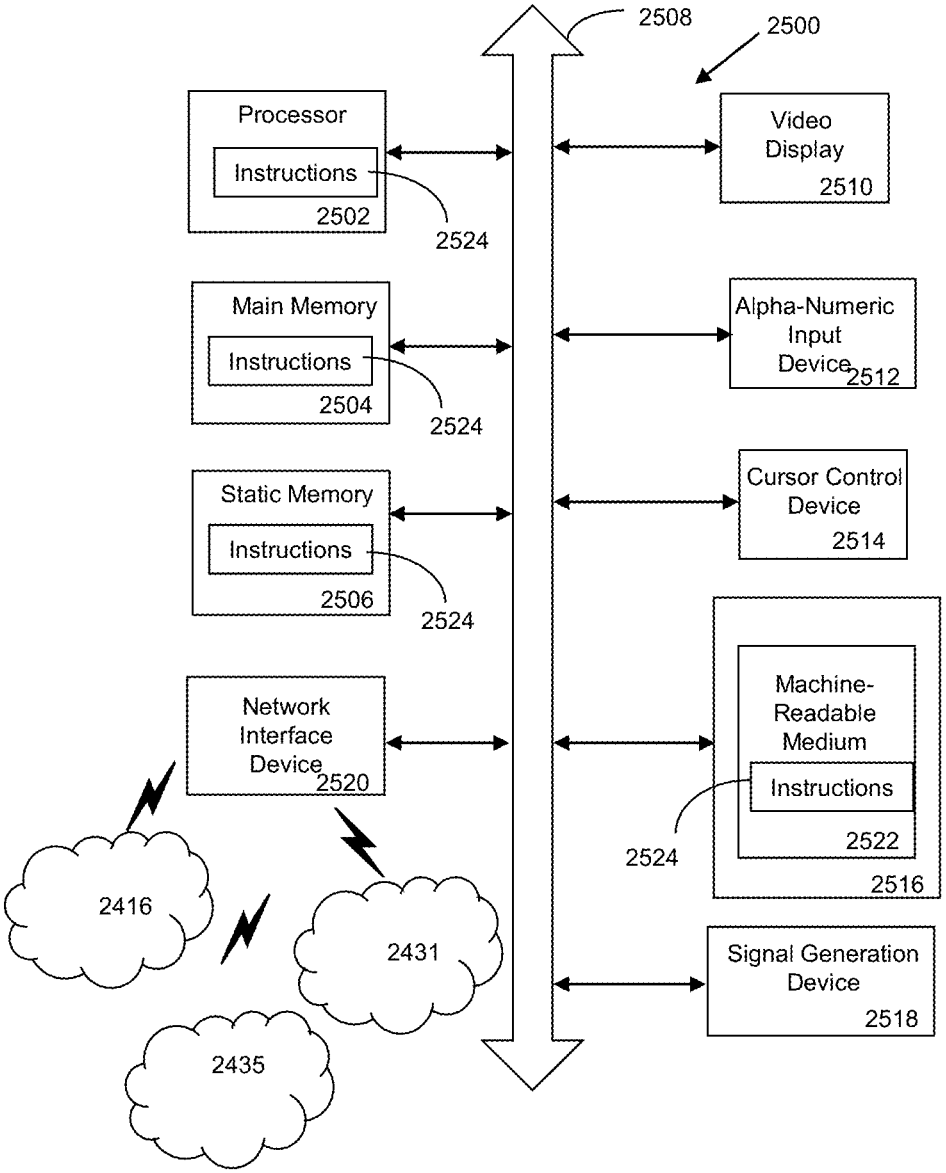
FIG. 9 is a schematic diagram of a machine in the form of a computer system which a set of instructions, when executed, may cause the machine to perform any one or more of the methodologies or operations of the systems and methods for utilizing an eartip according to embodiments of the present disclosure.

Referring now also to FIG. 9, at least a portion of the methodologies and techniques described with respect to the exemplary embodiments of the system 2400 can incorporate a machine, such as, but not limited to, computer system 2500, or other computing device within which a set of instructions, when executed, may cause the machine to perform any one or more of the methodologies or functions discussed above. The machine may be configured to facilitate various operations conducted by the system 2400. For example, the machine may be configured to, but is not limited to, assist the system 2400 by providing processing power to assist with processing loads experienced in the system 2400, by providing storage capacity for storing instructions or data traversing the system 2400, by providing functionality and/or programs for facilitating the operative functionality of the earphone devices 2415, 2430, and/or the first, second, third, fourth, and fifth user devices 2402, 2406, 2410, 2421, 2425 and/or the earphone devices 2415, 2430, by providing functionality and/or programs for facilitating operation of any of the components of the earphone devices 2415, 2430 (e.g. ear canal receivers, transceivers, ear canal microphones, ambient sound microphones, or by assisting with any other operations conducted by or within the system 2400.

In some embodiments, the machine may operate as a standalone device. In some embodiments, the machine may be connected (e.g., using communications network 2435, the communications network 2416, the communications network 2431, another network, or a combination thereof) to and assist with operations performed by other machines and systems, such as, but not limited to, the first user device 2402, the second user device 2411, the third user device 2410, the fourth user device 2421, the fifth user device 2425, the earphone device 2415, the earphone device 2430, the server 2440, the server 2450, the database 2455, the server 2460, or any combination thereof. The machine may be connected with any component in the system 2400. In a networked deployment, the machine may operate in the capacity of a server or a client user machine in a server-client user network environment, or as a peer machine in a peer-to-peer (or distributed) network environment. The machine may comprise a server computer, a client user computer, a personal computer (PC), a tablet PC, a laptop computer, a desktop computer, a control system, a network router, switch or bridge, or any machine capable of executing a set of instructions (sequential or otherwise) that specify actions to be taken by that machine. Further, while a single machine is illustrated, the term "machine" shall also be taken to include any collection of machines that individually or jointly execute a set (or multiple sets) of instructions to perform any one or more of the methodologies discussed herein.

The computer system 2500 may include a processor 2502 (e.g., a central processing unit (CPU), a graphics processing unit (GPU, or both), a main memory 2504 and a static memory 2506, which communicate with each other via a bus 2508. The computer system 2500 may further include a video display unit 2510, which may be, but is not limited to, a liquid crystal display (LCD), a flat panel, a solid state display, or a cathode ray tube (CRT). The computer system 2500 may include an input device 2512, such as, but not limited to, a keyboard, a cursor control device 2514, such as, but not limited to, a mouse, a disk drive unit 2516, a signal generation device 2518, such as, but not limited to, a speaker or remote control, and a network interface device 2520.

The disk drive unit 2516 may include a machine-readable medium 2522 on which is stored one or more sets of instructions 2524, such as, but not limited to, software embodying any one or more of the methodologies or functions described herein, including those methods illustrated above. The instructions 2524 may also reside, completely or at least partially, within the main memory 2504, the static memory 2506, or within the processor 2502, or a combination thereof, during execution thereof by the computer system 2500. The main memory 2504 and the processor 2502 also may constitute machine-readable media.

Dedicated hardware implementations including, but not limited to, application specific integrated circuits, programmable logic arrays and other hardware devices can likewise be constructed to implement the methods described herein. Applications that may include the apparatus and systems of various embodiments broadly include a variety of electronic and computer systems. Some embodiments implement functions in two or more specific interconnected hardware modules or devices with related control and data signals communicated between and through the modules, or as portions of an application-specific integrated circuit. Thus, the example system is applicable to software, firmware, and hardware implementations.

In accordance with various embodiments of the present disclosure, the methods described herein are intended for operation as software programs running on a computer processor. Furthermore, software implementations can include, but not limited to, distributed processing or component/object distributed processing, parallel processing, or virtual machine processing can also be constructed to implement the methods described herein.

The present disclosure contemplates a machine-readable medium 2522 containing instructions 2524 so that a device connected to the communications network 2435, the communications network 2416, the communications network 2431, another network, or a combination thereof, can send or receive voice, video or data, and communicate over the communications network 2435, the communications network 2416, the communications network 2431, another network, or a combination thereof, using the instructions. The instructions 2524 may further be transmitted or received over the communications network 2435, another network, or a combination thereof, via the network interface device 2520.

While the machine-readable medium 2522 is shown in an example embodiment to be a single medium, the term "machine-readable medium" should be taken to include a single medium or multiple media (e.g., a centralized or distributed database, and/or associated caches and servers) that store the one or more sets of instructions. The term "machine-readable medium" shall also be taken to include any medium that is capable of storing, encoding or carrying a set of instructions for execution by the machine and that causes the machine to perform any one or more of the methodologies of the present disclosure.

The terms "machine-readable medium," "machine-readable device," or "computer-readable device" shall accordingly be taken to include, but not be limited to: memory devices, solid-state memories such as a memory card or other package that houses one or more read-only (non-volatile) memories, random access memories, or other re-writable (volatile) memories; magneto-optical or optical medium such as a disk or tape; or other self-contained information archive or set of archives is considered a distribution medium equivalent to a tangible storage medium. The "machine-readable medium," "machine-readable device," or "computer-readable device" may be non-transitory, and, in certain embodiments, may not include a wave or signal per se. Accordingly, the disclosure is considered to include any one or more of a machine-readable medium or a distribution medium, as listed herein and including art-recognized equivalents and successor media, in which the software implementations herein are stored.

The illustrations of arrangements described herein are intended to provide a general understanding of the structure of various embodiments, and they are not intended to serve as a complete description of all the elements and features of apparatus and systems that might make use of the structures described herein. Other arrangements may be utilized and derived therefrom, such that structural and logical substitutions and changes may be made without departing from the scope of this disclosure. Figures are also merely representational and may not be drawn to scale. Certain proportions thereof may be exaggerated, while others may be minimized. Accordingly, the specification and drawings are to be regarded in an illustrative rather than a restrictive sense.

Thus, although specific arrangements have been illustrated and described herein, it should be appreciated that any arrangement calculated to achieve the same purpose may be substituted for the specific arrangement shown. This disclosure is intended to cover any and all adaptations or variations of various embodiments and arrangements of the invention. Combinations of the above arrangements, and other arrangements not specifically described herein, will be apparent to those of skill in the art upon reviewing the above description. Therefore, it is intended that the disclosure not be limited to the particular arrangement(s) disclosed as the best mode contemplated for carrying out this invention, but that the invention will include all embodiments and arrangements falling within the scope of the appended claims.

The foregoing is provided for purposes of illustrating, explaining, and describing embodiments of this invention. Modifications and adaptations to these embodiments will be apparent to those skilled in the art and may be made without departing from the scope or spirit of this invention. Upon reviewing the aforementioned embodiments, it would be evident to an artisan with ordinary skill in the art that said embodiments can be modified, reduced, or enhanced without departing from the scope and spirit of the claims described below.

While the present invention has been described with reference to exemplary embodiments, it is to be understood that the invention is not limited to the disclosed exemplary embodiments. The scope of the following claims is to be accorded the broadest interpretation so as to encompass all modifications, equivalent structures and functions of the relevant exemplary embodiments. For example, if words such as "orthogonal", "perpendicular" are used, the intended meaning is "substantially orthogonal" and "substantially perpendicular" respectively. Additionally, although specific numbers may be quoted in the claims, it is intended that a number close to the one stated is also within the intended scope, i.e. any stated number (e.g., 20 mils) should be interpreted to be "about" the value of the stated number (e.g., about 20 mils).

Thus, the description of the invention is merely exemplary in nature and, thus, variations that do not depart from the gist of the invention are intended to be within the scope of the exemplary embodiments of the present invention. Such variations are not to be regarded as a departure from the spirit and scope of the present invention.

What is claimed is:

1. An audio device comprising:

an ambient sound microphone configured to measure an ambient environment and generate an ambient signal;

an ear canal microphone configured to measure an ear canal environment and generate an ear canal signal;

a sealing unit;

a speaker;

a memory having computer instructions; and a processor coupled to the memory, wherein the processor executes the computer instructions thereby causing the processor to perform operations comprising:

sending a test signal to the speaker;

receiving the ear canal signal during the emission of the test signal by the speaker;

evaluating the ear canal signal to determine a seal integrity value;

sending a notification if the seal integrity value is below a threshold value;

retrieving a frequency dependent compression curve for a user if the seal integrity value is above the threshold;

applying the frequency dependent compression curve to the ambient signal to modified the ambient signal for enhanced speech intelligibility; and detecting if speech is present in the ambient signal.

2. The audio device according to claim 1, wherein the operations further comprise:

calculating an average sound pressure level of the ambient signal.

3. The audio device according to claim 2, wherein the operations further comprise:

selecting the frequency dependent compression curve to be retrieved based upon the average sound pressure level.

4. The audio device according to claim 3, wherein the threshold value is a correlation value between the test signal and the ear canal signal.

5. An audio device comprising:

an ambient sound microphone configured to measure an ambient environment and generate an ambient signal;

an ear canal microphone configured to measure an ear canal environment and generate an ear canal signal;

a sealing unit;

a speaker;

a memory having computer instructions; and a processor coupled to the memory, wherein the processor executes the computer instructions thereby causing the processor to perform operations comprising:

sending a test signal to the speaker;

receiving the ear canal signal during the emission of the test signal by the speaker;

evaluating the ear canal signal to determine a seal integrity value;

sending a notification if the seal integrity value is below a threshold value; and retrieving a frequency dependent compression curve for a user if the seal integrity value is above the threshold;

applying the frequency dependent compression curve to the ear canal signal to modified the ear canal signal for enhanced speech intelligibility; and detecting if speech is present in the ear canal signal.

6. The audio device according to claim 5, wherein the operations further comprise:

calculating an average sound pressure level of the ear canal signal.

7. The audio device according to claim 6, wherein the operations further comprise:

selecting the frequency dependent compression curve to be retrieved based upon the average sound pressure level.

8. The audio device according to claim 7, wherein the threshold value is a correlation value between the test signal and the ear canal signal.

9. An audio device comprising:

an ambient sound microphone configured to measure an ambient environment and generate an ambient signal;

an ear canal microphone configured to measure an ear canal environment and generate an ear canal signal;

a sealing unit;

a speaker configured to deliver sound to a user's ear canal;

a memory configured to store instructions; and a processor coupled to the memory, wherein the processor is configured to execute the instructions thereby causing the processor to perform operations comprising:

sending a test signal to the speaker, wherein the test signal has at least one frequency component at or below 60 Hz, wherein the sound pressure level for the frequency component is above the noise floor, where the noise floor is measured by the ear canal microphone before the test signal is emitted by the speaker, and wherein the test signal has a predetermined time length;

receiving the ear canal signal during the emission of the test signal by the speaker;

comparing the test signal sent to the speaker to the ear canal signal to determine a seal integrity value; and sending a notification if the seal integrity value is below a threshold value and a request to the user to adjust the audio device.

10. The audio device according to claim 9 wherein the operations further comprise:

retrieving a frequency dependent compression curve for the user if the seal integrity value is above the threshold.

11. The audio device according to claim 10, wherein the operations further comprise:

detecting if speech is present in the ambient signal.

12. The audio device according to claim 10, wherein the operations further comprise:

detecting if speech is present in the ear canal signal.

13. The audio device according to claim 9, wherein the operations further comprise:

receiving the ambient signal; and detecting if speech is present in the ambient signal.

14. The hearing device according to claim 9, wherein the operations further comprise:

receiving the ear canal signal; and detecting if speech is present in the ear canal signal.

15. The audio device according to claim 9, wherein the predetermined time length is greater than 1 second.

16. The audio device according to claim 9, wherein the test signal includes frequency components above 60 Hz.

17. The audio device according to claim 9, where the predetermined time length is between 1 second and 5 seconds.

18. An audio device comprising:

an ambient sound microphone configured to measure an ambient environment and generate an ambient signal;

an ear canal microphone configured to measure an ear canal environment and generate an ear canal signal;

a sealing unit;

a speaker;

a memory having computer instructions; and a processor coupled to the memory, wherein the processor executes the computer instructions thereby causing the processor to perform operations comprising:

sending a test signal to the speaker;

receiving the ear canal signal during the emission of the test signal by the speaker;

evaluating the ear canal signal to determine a seal integrity value;

sending a notification if the seal integrity value is below a threshold value;

receiving an output signal to be directed to the speaker;

selecting a frequency dependent compression curve to be retrieved based upon the average sound pressure level;

detecting if speech is present in the output signal; and calculating an average sound pressure level of the output signal.

19. The audio device according to claim 18, wherein if the seal integrity value is above the threshold the operations further comprise:

retrieving the frequency dependent compression curve.

20. The audio device according to claim 19, wherein if speech is detected in the output signal the operations further comprise:

applying the frequency dependent compression curve to the output signal to modified the output signal for enhanced speech intelligibility.

21. The audio device according to claim 20, wherein the operations further comprise:

sending the modified output signal to the speaker.

22. The audio device according to claim 21, wherein the threshold value is a correlation value between the test signal and the ear canal signal.

* * * * *